United States Patent [19]

Powlesland, deceased et al.

[11] 3,974,754

[45] Aug. 17, 1976

[54] CONTROLLED FLUID FLOW SYSTEMS

[75] Inventors: John W. Powlesland, deceased, late of Woodbridge, Canada; by James Kenneth Kidd, executor; by Isabella Powlesland, executrix, both of Woodbridge, Canada

[73] Assignee: Powlesland Engineering Limited, Rexdale, Canada

[22] Filed: Dec. 17, 1974

[21] Appl. No.: 533,613

[30] Foreign Application Priority Data

Dec. 4, 1974 Canada ..... 215459

[52] U.S. Cl. ..... 98/33 A

[51] Int. Cl.[2] ..... F24F 13/00

[58] Field of Search ..... 98/33 R, 33 A, 36, 115

[56] References Cited

UNITED STATES PATENTS

| | | | |
|---|---|---|---|
| 1,837,065 | 12/1931 | Pierce | 98/33 A |
| 2,319,703 | 5/1943 | Olson | 98/33 A |
| 2,487,570 | 11/1949 | Martin | 98/33 A |
| 3,000,290 | 9/1961 | Rodick | 98/33 R |
| 3,254,588 | 6/1966 | Truhan | 98/36 |
| 3,359,882 | 12/1967 | Givry | 98/33 R |
| 3,694,222 | 9/1972 | Pardoel | 98/33 R |

*Primary Examiner*—Lloyd L. King

*Attorney, Agent, or Firm*—Sim & McBurney

[57] ABSTRACT

This invention provides a method and apparatus for continuously moving gas from a first to a second location within an enclosed space. The gas is drawn from and exhausted to the exterior of the space. First, the gas is admitted from the exterior to a perforated plenum, and then the gas is moved at a relatively slow-speed out of the plenum toward the first location. The high-speed jet of gas is then originated at the first location within the slow-speed gas flow, and is directed toward the second location. This entrains additional gas from the first location and urges it toward the second. At the second location, the gas moving is exhausted to the exterior.

12 Claims, 4 Drawing Figures

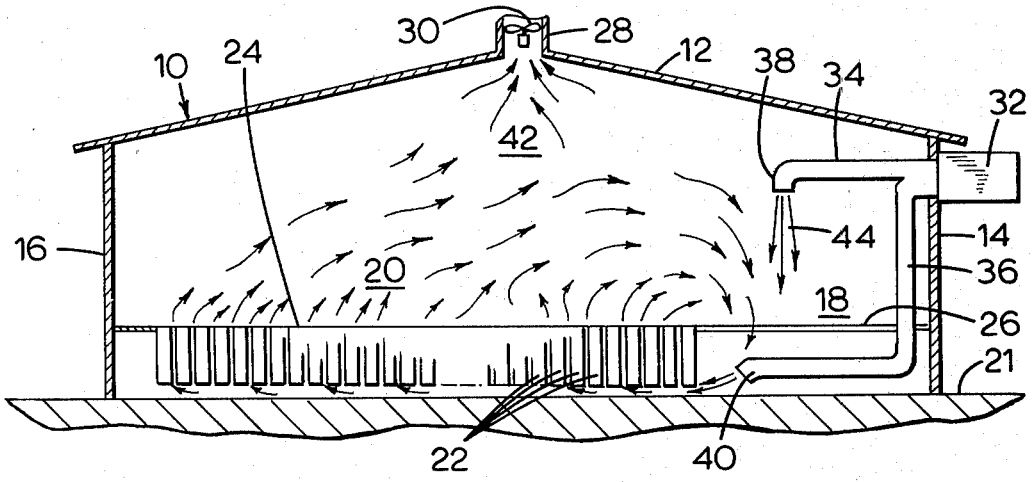
FIG. 1 (Prior Art)
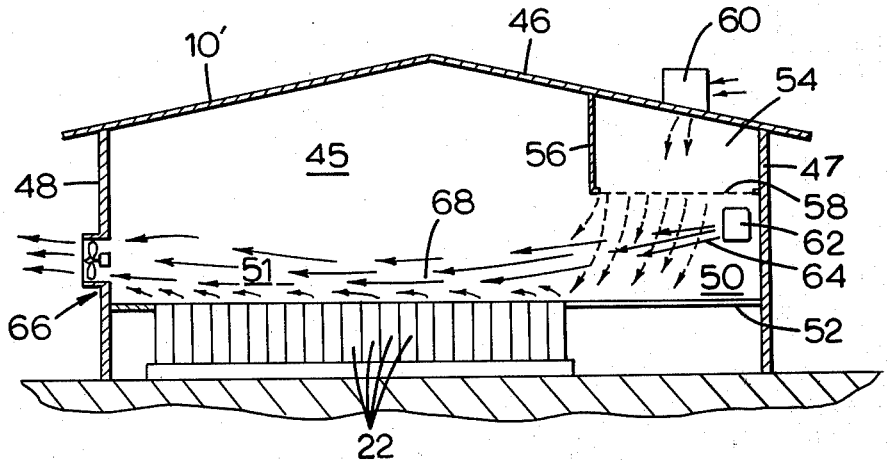
FIG. 2
FIG. 3
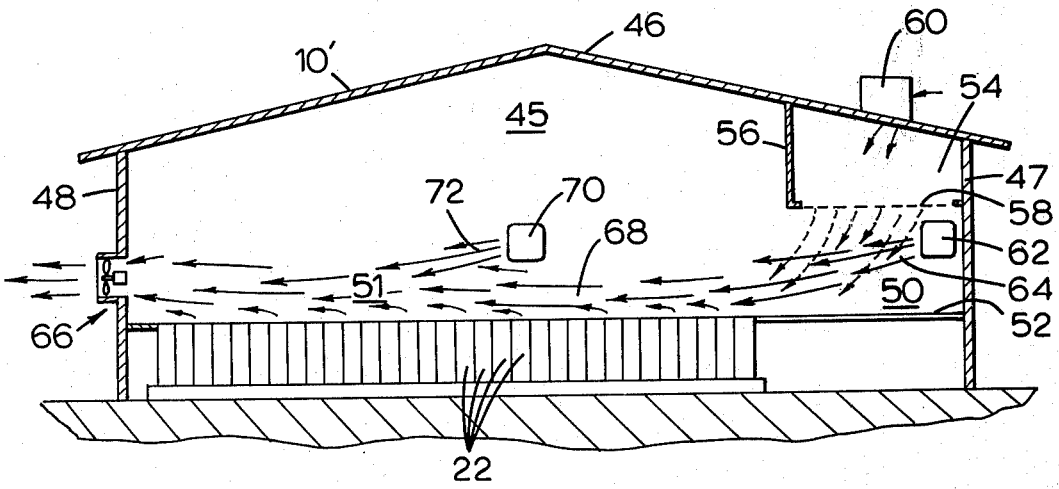

CONTROLLED FLUID FLOW SYSTEMS

This invention relates generally to the problem of moving a large mass of air or other gas from one location to another location within an enclosed space. More particularly, this invention has to do with a method and an arrangement of components by which a curtain of moving air or other gas can be established within an enclosed space.

BACKGROUND OF THIS INVENTION

It is well known that, for air or gas within a large enclosed space, the establishment of a single jet of such gas at one location within the enclosed space will give rise to a certain pattern of recirculating air current, due to the entrainment phenomenon. For this reason, many attempts to provide for the removal of noxious fumes and the like from a particular area within an enclosed space have failed due to the tendency for recirculation currents to draw the noxious fumes, etc. back around to another area within the enclosed space where they may pose a health hazard or other risk. One particular example of this kind of prior art arrangement will be discussed at a subsequent point in this disclosure in connection with one of the figures.

In view of the above-described failings of many conventional arrangements, it is an aspect of this invention to provide a method and an arrangement of components whereby air or other gas can be brought into an enclosed space from the exterior, moved from a first location to a second location within the enclosed space and then exhausted once more to the exterior, in such a way as to minimize the creation of entrainment-produced recirculation patterns within the enclosed space.

It is an aspect of a preferred form of this invention to permit a horizontal area within an enclosed space to be swept with a curtain of moving air or other gas, the gas being brought in from the exterior and ultimately exhausted again to the exterior, in such a way as to avoid setting up entrainment-produced recirculation patterns within the enclosed space.

GENERAL DESCRIPTION OF THE INVENTION

Accordingly, this invention provides a method of continuously moving from a first location to a second location within an enclosed space a gas which is drawn from and is exhausted to the exterior of said enclosed space, said method comprising the steps: admitting gas from the exterior into said enclosed space only by way of a plenum adjacent said first location, the plenum being perforate, passing gas at slow speed out of said perforate plenum and toward said first location, establishing at least one relatively high-speed jet of said gas at said first location and substantially within said slow speed gas, the at least one jet being directed toward said second location, thereby to entrain additional gas at said first location and urge it toward said second location, and at the second location exhausting to the exterior substantially all of said gas arriving at said second location.

In one embodiment, the method of this invention includes the step of establishing at a third location intermediate said first and said second locations, at least one further relatively high-speed jet of said gas directed toward said second location.

Also disclosed herein is a method of continuously sweeping a substantially horizontal area within an enclosed space with a moving gas originating and terminating outside of the enclosed space, comprising the steps: admitting gas from the outside to said enclosed space only by way of one side of said area, the plenum being perforate, passing gas at slow speed out of said perforate plenum and toward said one side of said area, establishing at least one relatively high-speed jet of said gas at said one side and substantially within said slow speed gas, the at least one jet being directed across said area toward the other side thereof, thereby to entrain additional gas at said first location and urge it across said area, and at the other side of said area exhausting to the exterior substantially all of said gas arriving at said other side.

In one embodiment, the first-mentioned jet is directed obliquely downwardly toward the said area, thereby to establish a moving curtain of gas sweeping across said area, the curtain of gas having an approximate upper boundary, the further jet having its point of origin above the upper boundary and being also directed obliquely downwardly, whereby the normal tendency for the curtain of gas from the first-mentioned jet to expand as it progresses is counteracted by said further jet due to the latter's downwardly oblique direction.

This invention further provides, in combination: an enclosure defining an interior space and separating said interior space from the exterior, a plenum within said enclosure, conduit means communicating said plenum with the exterior whereby gas from the exterior can be admitted to the plenum, said plenum being perforate to permit a relatively slow-speed flow of gas away from said perforate plenum, said plenum and conduit means being the only passageway by which gas from the exterior may enter the interior, apart from access doors and windows, and jet means adjacent said plenum and positioned so as to be substantially within such slow-speed gas flow, said jet means being adapted to propel a relatively a high-speed jet of said gas toward an exhaust location within said enclosure, thereby to entrain additional gas from said slow speed gas flow and urge it toward said exhaust location, and exhaust means at said exhaust location for exhausting to the exterior substantially all of said gas arriving at said exhaust location. In a preferred form, the slow-speed flow pattern essentially involves gas moving vertically downwardly beneath the plenum.

GENERAL DESCRIPTION OF THE DRAWINGS

Three embodiments of this invention are illustrated in the accompanying drawings, in which like numerals denote like parts throughout the several views, and in which:

FIG. 1 is a schematic vertical sectional view of a prior art construction;

FIG. 2 is a schematic vertical section through a first embodiment of this invention;

FIG. 3 is a schematic vertical section through a second embodiment of this invention.

PARTICULAR DESCRIPTION OF THE DRAWINGS

Figure 4:
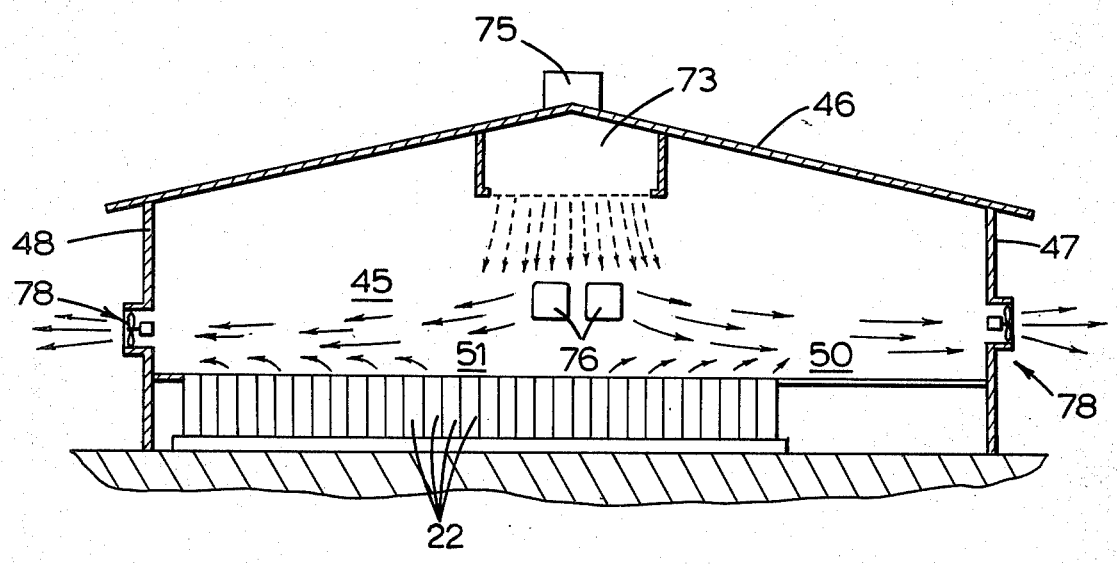
FIG. 4 is a schematic vertical section through a third embodiment of this invention.

Attention is first directed to FIG. 1 which shows in vertical section an enclosure 10 having a peak roof 12, a first vertical side wall 14, a second vertical side wall 16, a work area generally indicated by the numeral 18, and a fume-generating area generally indicated by the numeral 20. It is to be understood that the enclosure 10 would also include two end walls which are not illustrated in this essentially schematic drawing. The ground level is indicated at 21 and thus is will be seen that the work area 18 and the fume generating area 20 are both elevated with respect to the ground level 21.

Although the arrangement of FIG. 1 could represent many possible constructions in which it is desired to move a mass of air or other gas from one location to another location within an enclosed space, a better appreciation of this invention will result if we identify a particular industrial situation to which FIG. 1 could apply. In fact, FIG. 1 is based upon the design of an electrolytic cellhouse in which a large number of electrolytic cells 22 containing a fume-generating electrolyte are arranged such that they are recessed beneath a grid-like floor pattern 24 which is level with the floor 26 in the work area 18. The work area 18 is referred to in the trade as a stripping aisle. Most of the personnel employed in the electrolytic cellhouse are occupied on the stripping aisle (work area 18), although there is some requirement for certain personnel to move out into the fume-generating area 20 where the cells 22 are located.

The prior art arrangement illustrated in FIG. 1 includes certain specific provisions intended to keep the work area 18 clear of fumes generated in the cell 22, and further to exhaust such fumes upwardly through one or more central ventilation openings 28. In FIG. 1 a fan or other air-blowing means 30 is illustrated within the ventilation opening 28.

In the prior art arrangement, in order to encourage the fumes generated in the cells 22 to move upwardly and outward to the exterior through the ventilation opening or openings 28, there is provided an external plenum 32 containing air-impelling means (not shown) for the purpose of urging outside air through a first duct 34 and a second duct 36. As will be seen in FIG. 1, the first duct 34 debouches through a grill portion 38, and is directed vertically downwardly toward the floor 26 of the work area 18. Air passing into the second duct 36 is carried beneath the floor 26 and is blown out through an outlet 40 toward and underneath the banks of cells 22. The grid-like floor in the fume-generating area 20 has openings permitting the air to pass upwardly between the cells 22, through the floor in the fume-generating area 20 and out into the open space 42 centrally of the enclosure 10. It was intended that the air forced through the second duct 36 and underneath the banks of cells 22 would move directly upwardly in an essentially laminar flow pattern, carrying with it the fumes generated by the cells 22.

However it was discovered that the downward jet 44 from the first duct 34 had the effect of entraining some of the air-fume mixture travelling upwardly from the cells 22, and that as a result, the work area 18 became contaminated with fumes due to the recirculation pattern set up within the enclosure 10.

It will be understood that, even in the absence of the recirculation pattern due to the downward jet 44, any personnel working or standing in the fume-generating area 20 would be surrounded by a fume-air mixture and would be required to inhale it.

Attention is now directed to FIG. 2, for an explanation of the first embodiment of this invention, the purpose of which is to overcome the drawbacks and shortcomings of the prior art arrangement illustrated in FIG. 1.

In FIG. 2, an enclosure 10' defines an enclosed space 45 and includes a peak roof 46, a first side wall 47, a second side wall 48, two end walls (not visible in this vertical schematic section), a work area 50, and a fume-generating area 51. As with the prior art example above described, it is assumed that the enclosure 10' is an electrolytic cellhouse, in which the work area 50 is the stripping aisle where most of the personnel are located, and in which a plurality of electrolytic cells 22 are recessed beneath the grid-like floor of the fume-generating area 51. The floor 52 in the work area 50 is level with the floor in the fume-generating area 51.

In this embodiment of the present invention, there is provided, within the enclosure 10', a plenum 54 defined between a portion of the peak roof 46, a portion of the first side wall 47, a vertical partition 56, and a perforate bottom wall 58. Duct means 60 is provided for admitting air from the exterior of the enclosure 10' to the plenum 54. The bottom wall 58 of the plenum 54 is perforated or faraminated in such a way as to permit a relatively slow-speed flow of air through the bottom wall 58 and generally downwardly away from the plenum 54.

A jet means 62 is provided beneath the plenum 54 and is positioned so as to be substantially within the slow-speed air flow downwardly away from the plenum 54. The jet means 62 is adapted to propel a relatively high-speed jet 64 of air obliquely downwardly and generally toward the fume-generating area 51. It will be understood that the creation of the jet 64 by the jet means 62 must necessarily set up an entrainment pattern, but because the jet means 62 is located directly within the relatively slow-speed air flow downwardly from the plenum 54, almost all of the entrained air comes from the plenum 54. Thus, the creation of the high-speed jet 64 entrains additional air from the slow-speed air flow, and all of this air is urged toward and across the fume-generating area 51.

Further referring to FIG. 2, it will be noted that the second side wall 48 has exhaust means 66 for exhausting air to the exterior. The exhaust means 66 is sized in such a way as to be able to exhaust to the exterior substantially all of the air arriving at the exhaust means 66 as a result of the high-speed jet 64 and the additional air entrained by the high-speed jet 64. The exhaust means 66 is thus positioned at an exhaust location for the enclosed space 45 generally. As seen in FIG. 2, the arrangement of the components just described gives rise to a moving curtain 68 of air progressing toward the exhaust location established by the exhaust means 66.

Very little in the way of recirculating currents through the upper part of the enclosed space 45 is generated, due to the fact that virtually all of the air within the moving curtain 68 comes originally from the plenum 54, and virtually all of it is exhausted through the exhaust means 66. Furthermore, because the jet means 62 is directed obliquely downwardly, it it possible to control the upper boundary of the moving curtain 68 in such a way that a person standing in the fume-generating area 51 has his head above the moving curtain of air.

It will now be understood that any fumes generated in the cells 22 will be carried along as part of the moving curtain 68 of air, and will not be permitted to rise to the point where they could be inhaled by personnel standing in the fume-generating area 51. Furthermore, it will also be understood that virtually none of the fumes generated in the cells 22 will find their way back to the work area 50, by virtue of the fact that the plenum 54 supplies all of the air settling downwardly on the work area 50.

Attention is now directed to FIG. 3, in which the second embodiment of this invention is illustrated. Although the structure shown in FIG. 3 has slightly different dimensions from the structure of FIG. 2, the same numerals have been utilized for corresponding components, in order to avoid having to repeat the FIG. 2 description for FIG. 3.

The FIG. 3 embodiment differs from that illustrated in FIG. 2 by virtue of including a further jet means 70 located at an intermediate location between the first-described jet means 62 and the exhaust means 66. As can be seen in FIG. 3, the further jet means 70 is adapted to direct an obliquely downward jet 72 of air in the direction toward the exhaust means 66. It will also be noted that the further jet means 70 is located generally above the region of the uppper boundary of the moving curtain 68 of air. The reason for this positioning of the further jet means 70 is related to the natural tendency for the moving curtain 68 to expand to some extent as it progresses leftwardly from the work area 50. By virtue of the greater distance that must be travelled by the moving curtain of gas in FIG. 3 as compared to FIG. 2, it is possible that an unacceptable degree of expansion of the moving curtain 68 could take place before the air could reach the exhaust means 66 at the wall 48. The further jet means 70 counteracts this expansive tendency due to the downwardly oblique direction of the jet 72. Thus, the effect of the further jet means 70 is to "contain" the moving curtain 68 of air within close proximity to the floor of the fume-generating area 51, and to prevent undue expansion of the curtain.

Attention is now directed to FIG. 4, in which the third embodiment of this invention is illustrated. The general structure shown in FIG. 4 has roughly the same dimensions as that of FIG. 3, and for this reason the same numerals have been utilized for corresponding components. This avoids having to repeat descriptive material that does not go to the heart of the invention.

The embodiment illustrated in FIG. 4 differs from the embodiment shown in FIGS. 2 and 3 by virtue of the fact that a centrally located plenum 73 is positioned beneath the peak of the roof 46, and has intake means 75 located above the peak.

In the case of the embodiment of FIG. 4, primary jets of air are expelled in both directions away from the central area of the interior 45 of the enclosure. In order to accomplish this, twin jet means 76 are provided at a location suspended below the plenum 73. The plenum 73 is adapted to permit a slow-speed flow of air generally downwardly to encompass the jet means 76. As can be seen, two exhaust means 78 are provided, one at either side wall 47, 48 of the enclosure. The curtain of air to which each of the jet means 76 gives rise is exhausted through its respective one of the exhaust means 78.

Since all of the air entering the enclosure 45 from the outside, for any of the three embodiments, comes in by way of a plenum, it would be possible to utilize the plenum construction to heat or pre-heat this air where necessary due to cold weather conditions. Naturally, it would also be possible to heat the air in or at the point where it is expelled by the jet means 62, 70, 76.

It is to be understood that the principle elaborated above in connection with the components illustrated in FIGS. 2 to 4 could be utilized apart from the specific function of "sweeping" a given floor area. It is considered, for example, that this invention relates generally to a method of continuously moving air or gas within an enclosed space from a first location to a second location within the space, and the particular path of movement need not necessarily be adjacent a floor or wall area. Although the ability of the disclosed arrangement of components to sweep a particular floor area is considered a special advantage of the preferred embodiment, this construction and arrangement is not to be considered in a limiting sense. More specifically, the downward oblique direction of the jets 64 and 72 in FIG. 3 would not constitute essential characteristics of the arrangement of components where it was not desired to sweep a floor area.

It is considered an important feature of this invention that the plenum designated by the numbers 54 and 73 in FIGS. 2, 3 and 4, represent the only, or substantially the only, passageway by which gas (air) from the exterior of the enclosure may enter the interior, apart from access doors and windows, etc. The reason for this will be clear when it is considered that the strength of the jet means 62, 70 and 76 in the different embodiments of this invention must be substantially matched to the capacity of the exhaust means 66, 78, otherwise there will arise a tendency to set up recirculation patterns within the space above the moving curtain of air, particularly in the case where more air is arriving at the exhaust means than can be exhausted by the same. If, for example, the enclosure included a substantially open passageway to the exterior, such as is constituted by the central ventilation opening 28 in the prior art construction shown in FIG. 1, it will be appreciated that external wind velocities and direction could constitute an important factor in determining the internal flow patterns, and sudden changes in these external conditions could set up very undesirable patterns on the inside of the enclosure. For this reason, it is considered important that the plenum, with its ability to control the admission of air into the region where the jet means is associated, be substantially the only entry passageway, apart from access doors and windows.

What I claim as my invention is:

1. A method of continuously moving from a first location to a second location within an enclosed space a gas which is drawn from and is exhausted to the exterior of said enclosed space, said method comprising the steps:

admitting gas from the exterior into said enclosed space only by way of a plenum adjacent said first location, the plenum being perforate, passing gas at slow speed out of said perforate plenum and toward said first location, establishing at least one relatively high-speed jet of said gas at said first location and substantially within said slow speed gas, the at least one jet being directed toward said second location, thereby to entrain additional gas at said first location and urge it toward said second location, and at the second location exhausting to the exterior substantially all of said gas arriving at said second location.

2. The method claimed in claim 1, in which the passing of gas out of said perforate plenum involves gas moving vertically downward from the plenum to said first location, the latter being beneath the plenum.

3. The method claimed in claim 1, which further includes the step of establishing, at a third location intermediate said first and second locations, at least one further relatively high-speed jet of said gas directed toward said second location.

4. A method of continuously sweeping a substantially horizontal area within an enclosed space with a moving gas originating and terminating outside of the enclosed space, comprising the steps:

admitting gas from the outside to said enclosed space only by way of a plenum adjacent one side of said area, the plenum being perforate, passing gas at slow speed out of said perforate plenum and toward said one side of said area, establishing at least one relatively high-speed jet of said gas at said one side and substantially within said slow speed gas, the at least one jet being directed across said area toward the other side thereof, thereby to entrain additional gas at said first location and urge it across said area, and at the other side of said area exhausting to the exterior substantially all of said gas arriving at said other side.

5. The method claimed in claim 4, in which said step of passing gas at slow speed out of said perforate plenum involves passing the gas vertically downward from the plenum to said one side of said area, the said one side being substantially underneath the plenum.

6. The method claimed in claim 5, which further includes the step of establishing within said area at least one further relatively high-speed jet of said gas directed toward said other side of said area.

7. The method claimed in claim 6, in which said first-mentioned jet of said gas is directed obliquely downwardly toward said area, thereby to establish a moving curtain of gas sweeping across said area, the curtain of gas having an approximate upper boundary, and in which said further jet has its point of origin above said upper boundary and is also directed obliquely downwardly, whereby the normal tendency for the curtain of gas from said first-mentioned jet to expand as it progresses is counteracted by said further jet due to the latter's downwardly oblique direction.

8. In combination:

an enclosure defining an interior space and separating said interior space from the exterior, a plenum within said enclosure, conduit means communicating said plenum with the exterior whereby gas from the exterior can be admitted to the plenum, said plenum being perforate to permit a relatively slow-speed flow of gas away from said perforate plenum, said plenum and conduit means being the only passageway by which gas from the exterior may enter the interior, apart from access doors and windows, and jet means adjacent said plenum and positioned so as to be substantially within such slow-speed gas flow, said jet means being adapted to propel a relatively high-speed jet of said gas toward an exhaust location within said enclosure, thereby to entrain additional gas from said slow-speed gas flow and urge it toward said exhaust location, and exhaust means at said exhaust location for exhausting to the exterior substantially all of said gas arriving at said exhaust location.

9. The combination claimed in claim 8, in which said plenum is perforated at a bottom portion thereof, whereby said slow-speed flow pattern essentially involves gas moving vertically downward beneath the plenum, the jet means being located beneath the plenum.

10. The combination claimed in claim 8, including a further jet means between said first-mentioned jet means and said exhaust location, said further jet means being adapted to urge a jet towards said exhaust location.

11. The combination claimed in claim 9, in which the enclosure houses a substantially horizontal area, said jet means being directed obliquely downward toward and across said horizontal area to give rise to a moving curtain of said gas progressing toward said exhaust location, said curtain of gas having an approximate upper boundary.

12. The combination claimed in claim 11, including a further jet means between said first-mentioned jet means and said exhaust location, and located above said upper boundary, said further jet means being directed obliquely downwardly and toward said exhaust location, whereby the normal tendency for the curtain of gas from said first-mentioned jet to expand as it progresses is counteracted by said further jet due to the latter's downwardly oblique direction.

* * * * *